US005135051A

United States Patent [19]

Facteau et al.

[11] Patent Number: 5,135,051

[45] Date of Patent: Aug. 4, 1992

[54] PERFORATION CLEANING TOOL

[76] Inventors: David M. Facteau, 2601 Emerson, Midland, Tex. 79705; Timothy A. Cobb, 1416 Sierra Springs, #1815, Bedford, Tex. 76021; Michael D. Hyman, 2206 Madera, Odessa, Tex. 79763

[21] Appl. No.: 716,262

[22] Filed: Jun. 17, 1991

[51] Int. Cl.[5] ..... E21B 37/00

[52] U.S. Cl. ..... 166/104; 166/171

[58] Field of Search ..... 166/104, 170, 171

[56] References Cited

U.S. PATENT DOCUMENTS 1,230,666 6/1917 Carden ..... 166/104
1,333,390 3/1920 Dickinson ..... 166/104
2,574,141 11/1951 Brown ..... 166/171
2,661,065 12/1953 McCoy ..... 166/171

*Primary Examiner*—Thuy M. Bui
*Attorney, Agent, or Firm*—Dodge, Bush, Moseley & Riddle

[57] ABSTRACT

In accordance with an illustrative embodiment of the present invention, a well perforation cleaning tool includes a fluidic oscillator that creates pressure changes which induce cyclical stresses in the damaged skins of the perforations and causes the skins to disintegrate in order to improve the productivity of the well. Cylindrical filter tubes having a plurality of sets of slots are adjustably mounted at the upper and lower ends of the tool to provide resistances which confine the pressure changes to the immediate vicinity of the perforated interval.

7 Claims, 1 Drawing Sheet

FIG. 1
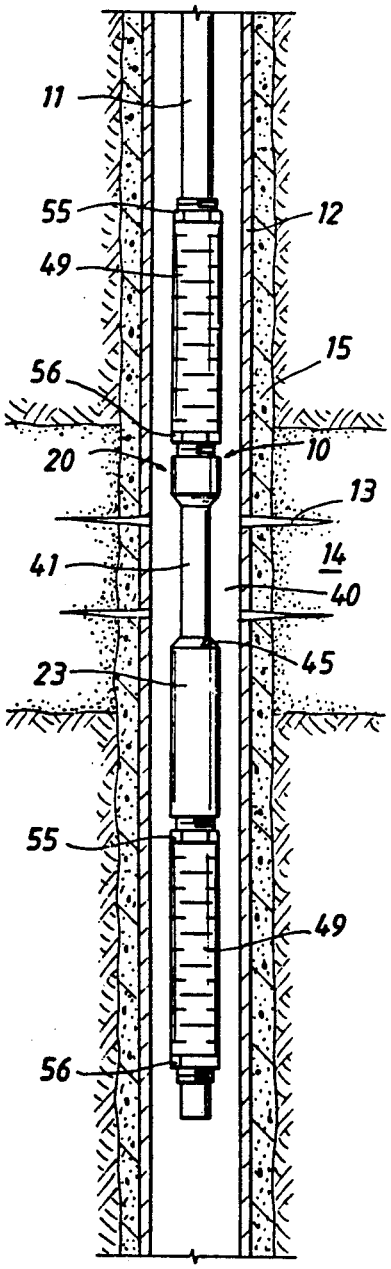
FIG. 2A
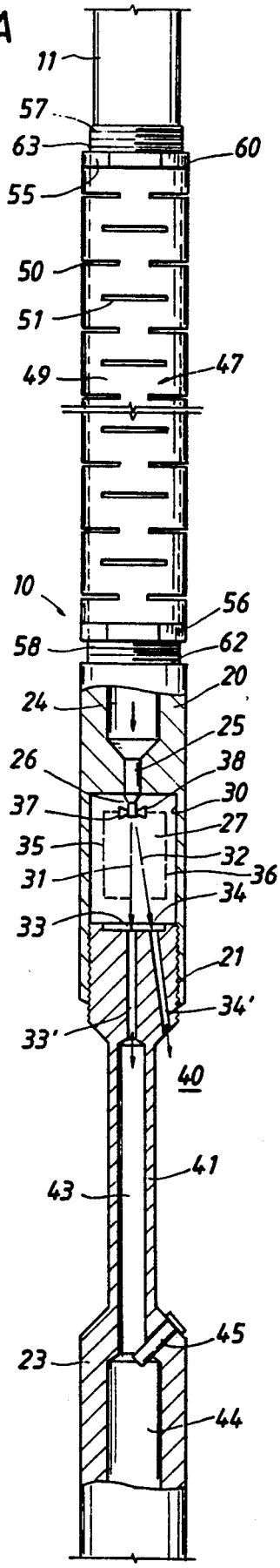
FIG. 2B
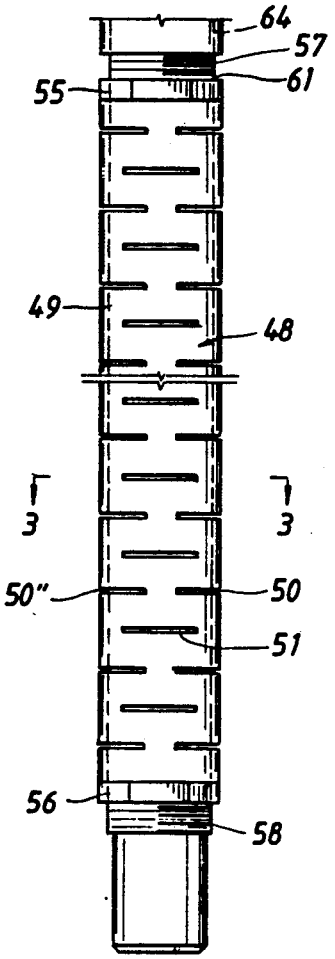
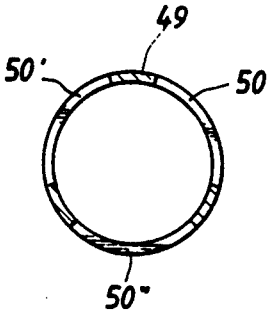
FIG. 3

PERFORATION CLEANING TOOL

FIELD OF THE INVENTION

This invention relates generally to a tool for cleaning perforations that provide fluid communication between a well casing and an earth formation that produces hydrocarbons, and particularly to a new and improved perforation cleaning tool that creates rapid pressure changes which induce stresses in the walls of a perforation tunnel to disintegrate an impermeable skin thereon and thus increase the production capability thereof.

BACKGROUND OF THE INVENTION

A cleaning tool that uses a fluidic oscillator to create pressure fluctuations in the well bore adjacent a perforated interval to clean the perforations has been proposed. See SPE Paper No. 13803 entitled "Pressure Fluctuating Tool" by Payne, Williams, Petty and Bailey. The pulses from a fluidic oscillator are fed to respective fluid-filled chambers that are communicated by an inertia tube. Oscillating or fluctuating pressures are created in the annular space between the tool and the casing wall. Acoustic filters in the form of gas-filled rubber bladders are positioned in the tool above and below the primary oscillation zone to limit the propagation of the acoustic signals up and down the well bore, and to concentrate the pressure fluctuations to an adjacent interval of the perforations. The pressure fluctuations are said to remove debris from the perforations and pulverize any impermeable skin on the wall of the perforation tunnel, which can be caused by current methods of shaped charge perforating. Oil production from the perforations is thereby increased, and the ability to stimulate the formation using various techniques is enhanced.

However, the combination of components used in this device, particularly the elastomer bladder filters, provides a tool that is very long, in the order of 30 feet. Such a lengthy tool is quite cumbersome to handle and requires a large vehicle to transport it to and from a job site. The tool also has an outer diameter such that it can be operated only in well casings having a fairly large size which is above a size that is commonly found in many oil producing areas. Moreover, the use of acoustic filters that are placed at fixed distance above and below the resonance zone can have less than optimum performance due to inability to adjust or fine-tune the system.

The general object of the present invention is to provide a new and improved perforation cleaning tool that obviates the foregoing problems.

Another object of the present invention is to provide a new and improved tool of the type described having relatively short comments that can be transported in a car trunk or in any small, truck-type vehicle.

Another object of the present invention is to provide a new and improved tool of the type described that can be used in 4½" as well as large size casing.

Still another object of the present invention is to provide a new and improved tool of the type described that includes an acoustic filter system that can be adjusted to fine-tune or calibrate the tool for maximum efficiency.

SUMMARY OF THE INVENTION

These and other objects are attained in accordance with the concepts of the present invention through the provision of a perforation cleaning tool that includes a tubular body having upper and lower internal chambers, the upper chamber containing a fluidic oscillator block which is supplied with an operating liquid through the pipe string or which the tool is suspended. One outlet of the block is communicated with the annular well bore spaced between the body and the casing, and the other outlet is communicated with the lower chamber which functions as a fluid capacitor. The annular space outside also provides a fluid capacitor, and the annulus and the lower chamber are coupled by an inductor or inertia tube that extends through the wall of the lower chamber. Upper and lower filters are connected to the respective opposite ends of the body, and function to substantially block the transmission of acoustic waves up or down the casing. Each filter includes an elongated tubular member that is mounted on a sub that is connected to the tool body, and has a series of narrow axially spaced slots formed through the walls thereof. So constructed, the tubular members provide resistances in the fluid network, and limit the length of the pressure zone to the cleaning interval. Each of the resistance members can be adjusted axially with respect to the body to fine-tune or calibrate the tool for maximum efficiency.

BRIEF DESCRIPTION OF THE DRAWINGS

The present invention has other objects, features and advantages which will become more clearly apparent in connection with the following detailed description of a preferred embodiment, taken in conjunction with the appended drawings in which:

FIG. 1 is a schematic view showing the perforation cleaning tool of the present invention operating in a cased and perforated well bore;

FIGS. 2A and 2B are longitudinal sectioned views, with some portions in side elevation, of the perforation cleaning tool of FIG. 1, FIG. 2B being a lower continuation of FIG. 2A; and FIG. 3 is a cross-section on line 3—3 of FIG. 2B.

DETAILED DESCRIPTION OF A PREFERRED EMBODIMENT

Referring initially to FIG. 1, a cleaning tool 10 in accordance with the present invention is shown suspended on a running string 11 of tubing that extends upward to the surface. The tool 10 has been lowered into a well casing 12 until it is located opposite an interval of perforations 13 that are to be cleaned. The perforations 13 are formed by conventional means to provide a plurality of radially extending, generally carrot-shaped tunnels through which oil and/or gas from the formation 14 enters the well casing 12.

The explosion of shaped charges penetrates the casing wall, the cement sheath 15, and fairly deeply into the rock of the formation 14. The extremely high energy by which the perforations 13 are formed often produces a "skin" on the walls of the tunnels which is substantially impermeable. Unless some remedial action is taken, the production of hydrocarbons through the walls of the tunnels can be greatly reduced. Moreover, the damage can inhibit the effectiveness of various stimulation procedures where a treating fluid is to be pumped into the formation under pressure.

As shown in FIG. 2A, the tool 10 includes an oscillator sub 20 that is connected by threads 21 at its low end to the upper end of a tubular mandrel 23. The upper end portion of oscillator sub 20 has a central bore 24 that leads to a passage 25 which provides the input to the power nozzle 26 of a fluidic oscillator block 27. The bock 27 is mounted in a chamber 30 formed in the sub 20, and has a pair of diffuser passages 31, 32 that incline downward and outward in opposite directions, and which lead to output ports 33, 34. Feedback passages 35, 36 extend from the respective lower end portions of the diffuser passages 31, 32 back up to control nozzles 37, 38 on the opposite sides of the power nozzle 26. When supplied with fluid being pumped down the tubing 11, the fluid flow from the power nozzle 26 is switched back and forth between the diffuser legs 31, 32 and creates pressure changes in fluid zones that are communicated with the respective outputs 33, 34.

The output port 34 communicates with a passage 34' that opens into the annular well bore space 40 between the reduced diameter section 41 of the mandrel 23 and the adjacent inner wall of the casing 12. The other port 33 communicates with a passage 33' that leads to an upper chamber portion 43 inside the section 41, which opens downward into a lower chamber portion 44 therein. The space 40 and the upper end of the lower chamber portion 44 are connected by an inductance tube 45 that permits a degree of fluid transfer between the chambers 41, 44 and the annular space 40. The fluids in the annular space 40, having some compliance due primarily to fluid compressibility, provide, in effect, a fluid capacitor, as do the fluids in the chamber portion 44. The inertia of the fluid mass in the tube 45 is considered to provide an effect that is analogous to inductance. The chambers 43, 44 and the annular space 40 alternately receive short duration pressure pulses from the oscillator block 27 which are superposed on hydrostatic pressure at tool depth to provide resultant pressures that changed rapidly in the nature of a sine wave and have peak-to-peak values that are considerably above and below the static head pressure. The pressure changes have their greatest amplitudes in the region 40 immediately adjacent the perforations 13.

In order to confine the pressure fluctuations to the well bore region adjacent the tool 10, upper and lower acoustic filters indicated generally at 47 and 48 are used in accordance with the present invention. Each of these filters is an elongated hollow tube 49 having a plurality of sets of transverse slots formed through the wall thereof. The upper tube 49 is mounted on a tubular member 60 and the lower tube is mounted on another tubular member 61. The lower end of the member 60 is threaded at 62 to the upper end of the oscillator sub 20, and at its upper end is threaded at 63 to the lower end of the tubing string 11. The upper end of the lower tubular member 61 is threaded at 64 to the lower end of the body 23. As shown in FIG. 3, each of the slots 50 of each set are evenly spaced around the circumference of the tube 49, with each slot extending through an angle of about 90°. The adjacent set of slots 51, are formed in the same fashion, but is angularly offset by about 60°. The slot sets are arranged on an equal, fairly close axial spacing along the length of the respective tubes 49 and 50, and extend substantially throughout such length. By virtue of the slots, each of the tubes 49 operates as a resistance in the fluid network, which limits the propagation of pressure changes upward and downward in the well bore that is outside the resonant zone between the filters.

The axial position of each of the filter tubes 49 with respect to the region 40 immediately outside the reduced diameter mandrel portion 41 can be adjusted to fine-tune or calibrate the tool 10. Ideally, the filters 49 should be located centrally of node points of the acoustic waves. To provide axial adjustment, nuts 55, 56 are provided at the opposite ends of the tubes 49 and are threaded to respective threads at sections 57, 58 on the tubular members 60 and 61. Thus each of the tubes 49 can be moved axially a limited amount, and the nuts 55, 56 retightened against their opposite ends to establish a different position.

OPERATION

In operation, the tool 10 is connected to the lower end of the tubing string 11 and lowered into the well until the mandrel section 41 is opposite an interval of perforations 13 to be cleaned. Surface pumps (not shown) are used to pump fluid down the tubing 11 at a selected rate that will provide resonant frequency operation of the tool 10. The fluid returns to the surface through the annulus between the tubing 11 and the casing 12.

The oscillator block 27 operates to apply alternating pressure pulses to the region 40 via the outlet 34, and to the chambers 43 and 44 via the outlet 33 and the passage 33'. The chambers 43 and 44 are connected to the region 40 by the inertia tube 45. By way of a typical example, the pressure in the region 40 can be fluctuated between peak-to-peak values having a difference of about 2,000 psi. Where the hydrostatic head pressure is 2,500 psi, the pressures in the region 40 will vary between about 3,500 psi and about 1,500 psi. A typical frequency can be about 150 $H_2$.

The walls of the perforation 13 are subjected to such pressure changes, which induce cyclical tension and compressive stresses therein. The impermeable skin rapidly breaks down and disintegrates, and the debris can be removed by fluid circulation. The perforations 13 are thus cleaned out, and the productivity index of the formation greatly increased. The time that the cleaning tool 10 is left in operation adjacent a group of perforations 13 depends on the type of formation, with weaker rocks such as limestone needing less cleaning time than stronger rocks such as dolomites.

The filter members 47 and 48 function to provide a fluid resistance that confines the changing pressures to a length of the well bore that is from about midway of the upper member to about midway of the lower member. Such filters thus concentrate the pressure changes to the cleaning zone, and substantially prevent transmission of acoustic waves up or down hole from the tool 10. To enhance the efficiency of the tool 10, the members 47 can be adjusted up or down their respective mandrels 60, 61' prior to running the tool into the well in order to fine-tune or calibrate the tool.

The overall construction of the present invention provides a tool having relatively short length components. For example the body 20 can have an overall length of about three (3) feet, and each of the filters 49 an overall length of about two (2) feet. Thus the components can be readily transported to and from a job site in a small space such as the trunk of a car. The use of the filter construction allows the tool to be built with a diameter such that it can be used standard 4½ inch casing, as well as larger sizes.

It now will be recognized that a new and improved perforation cleaning tool that is compact in design and more reliable in operation has been disclosed. Since certain changes or modifications may be made in the disclosed embodiment without departing from the inventive concepts involved, it is the aim of the following claims to cover all such changes and modifications that fall within the true spirit and scope of the present invention.

What is claimed is:

1. In a well tool for use in cleaning a perforation that extends from a well bore into a formation, said well tool having an elongated tubular body with upper and lower chambers therein, fluidic oscillator means in said upper chamber having first and second outlets, said oscillator means being responsive to the flow of fluids in said running string for creating alternating pressure pulses at said first and second outlets; means communicating said first outlet with said lower chamber; means communicating said second outlet with the annular well bore region externally of said body and said lower chamber; the improvement comprising: cylindrical filter means mounted adjacent the respective upper and lower ends of said body for concentrating said pressure variations in said annular region and for substantially isolating the well bore above and below said filter means from said pressure pulses.

2. The well tool of claim 1 wherein each of said cylindrical filter means comprises an elongated tube having a plurality of axially spaced slots through the wall thereof.

3. The well tool of claim 2 wherein said slots are arranged in circumferentially spaced sets, ones of said sets of slots being angularly offset with respect to an adjacent set thereof.

4. The well tool of claim 1 further including an upper sub connected to the upper end of said body and a lower sub connected to the lower end thereof, said upper and lower cylindrical filter means being mounted on respective ones of said upper and lower subs.

5. The well tool of claim 4 further including means for adjusting the axial spacing of said upper and lower filter means with respect to one another.

6. The well bore of claim 5 when said adjusting means comprises nut members threaded on said subs and engaging the upper and lower ends of said cylindrical filter means.

7. The well tool of claim 1 further including a fluid transfer tube for communicating said annular well bore region with said lower chamber.

* * * * *